US011480341B2

(12) United States Patent
Meurer et al.

(10) Patent No.: US 11,480,341 B2
(45) Date of Patent: Oct. 25, 2022

(54) HINGE FOR A HOUSEHOLD APPLIANCE

(71) Applicant: Apparatebau Gronbach S.r.l., Laag/Neumarkt (IT)

(72) Inventors: Gerold Meurer, Margeid an der Weinstraße (IT); Massimiliano Margonari, Trento (IT)

(73) Assignee: Apparatebau Gronbach S.r.l., Laag/Neumarkt (IT)

( * ) Notice: Subject to any disclaimer, the term of this patent is extended or adjusted under 35 U.S.C. 154(b) by 0 days.

(21) Appl. No.: 16/230,109

(22) Filed: Dec. 21, 2018

(65) Prior Publication Data

US 2019/0203947 A1 Jul. 4, 2019

(51) Int. Cl.

| | |
|---|---|
| ***F24C 15/02*** | (2006.01) |
| ***E05F 1/12*** | (2006.01) |
| ***E05F 15/622*** | (2015.01) |

(52) U.S. Cl.

CPC ..... *F24C 15/023* (2013.01); *E05F 1/1276* (2013.01); *E05F 15/622* (2015.01); *E05Y 2201/10* (2013.01); *E05Y 2900/30* (2013.01); *E05Y 2900/304* (2013.01); *E05Y 2900/308* (2013.01)

(58) Field of Classification Search

CPC ... A47B 88/457; E05Y 15/622; E05Y 1/1276; E05Y 15/611; F24C 15/023

See application file for complete search history.

(56) References Cited

U.S. PATENT DOCUMENTS

| | | | | |
|---|---|---|---|---|
| 3,414,933 A | | 12/1968 | Wilhelm | |
| 5,513,467 A | * | 5/1996 | Current | E05F 1/105 49/139 |
| 6,223,469 B1 | * | 5/2001 | Moll | E05F 15/611 49/341 |
| 9,062,488 B2 | * | 6/2015 | Sasaki | E05F 15/611 |
| 9,074,400 B2 | * | 7/2015 | Mirshekari | E05F 1/1261 |

(Continued)

FOREIGN PATENT DOCUMENTS

| | | | |
|---|---|---|---|
| CN | 201273102 | | 7/2009 |
| CN | 201372664 Y | * | 12/2009 |

(Continued)

OTHER PUBLICATIONS

European Patent Office, Extended European Search Report issued in European Patent Application No. 18 425 001.7, dated Jul. 3, 2018, 7 pp.

(Continued)

*Primary Examiner* — Bobby Rushing, Jr.
(74) *Attorney, Agent, or Firm* — Fitch, Even, Tabin & Flannery LLP

(57) ABSTRACT

The invention relates to a hinge for a household appliance, including a hinge housing, including a pivot arm, which is pivotably retained at the hinge housing, and including a drive device, which comprises an electric motor, by means of which the pivot arm is pivotable relative to the hinge housing, wherein the drive device includes: a drive housing formed separately from the hinge housing, provided in addition thereto and at least partially following the hinge housing in longitudinal extension direction of the hinge housing; a threaded spindle at least partially received in the hinge housing; and at least one screw element screwed to the threaded spindle.

15 Claims, 2 Drawing Sheets

(56) References Cited

U.S. PATENT DOCUMENTS

Figure 1:
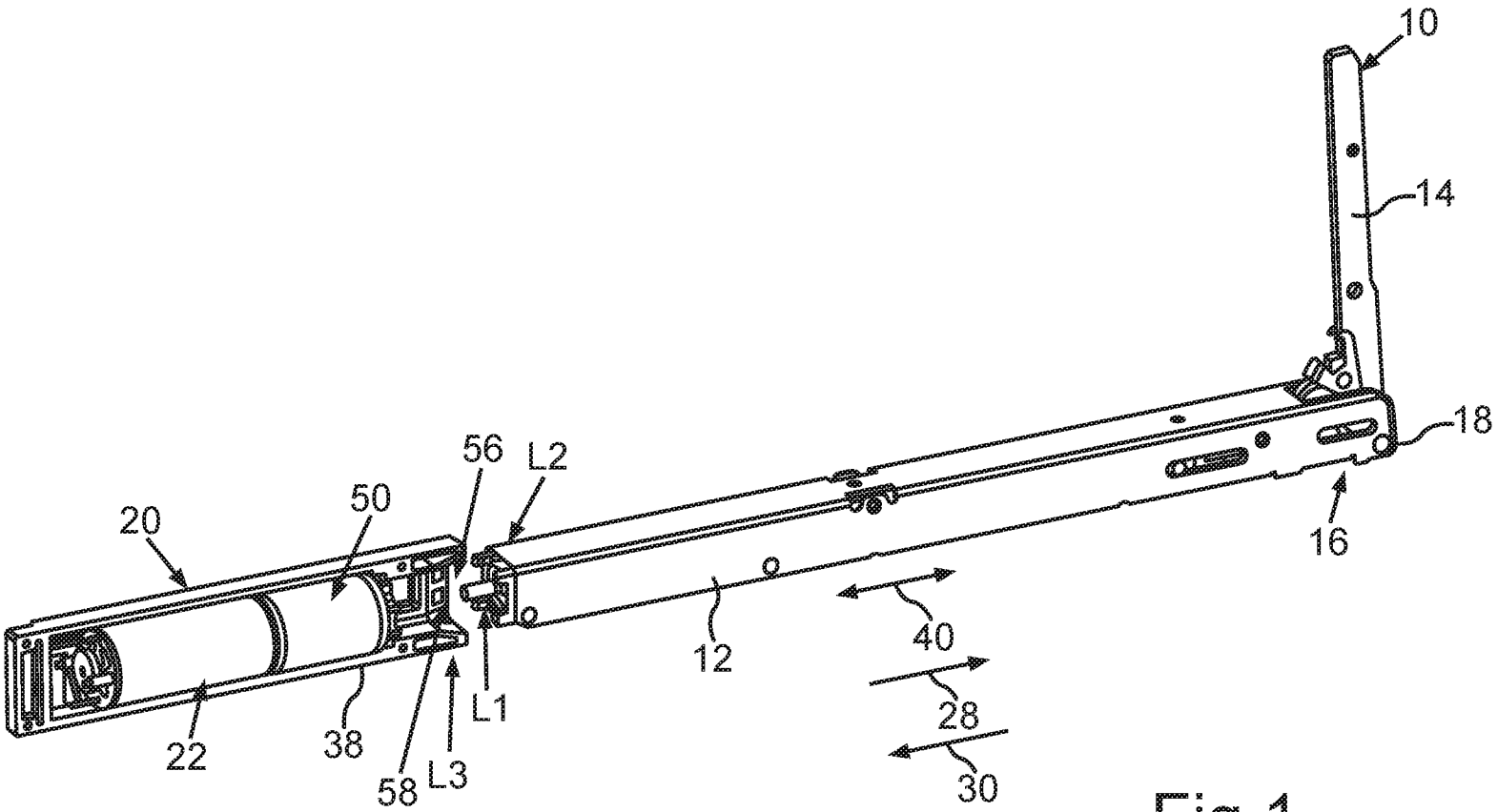

| | | | | |
|---|---|---|---|---|
| 2007/0267401 | A1 | 11/2007 | Collene | |
| 2011/0302841 | A1* | 12/2011 | Ye | E05F 15/622 49/340 |
| 2017/0292311 | A1* | 10/2017 | Podkopayev | E05F 15/622 |

FOREIGN PATENT DOCUMENTS

| | | | |
|---|---|---|---|
| CN | 102797402 | | 11/2012 |
| CN | 102797402 | A * | 11/2012 |
| CN | 103437628 | | 12/2013 |
| CN | 206693828 | | 12/2017 |
| DE | 29605182 | | 5/1996 |
| DE | 10343519 | | 4/2005 |
| DE | 102005017085 | | 10/2006 |
| DE | 102013011939 | | 2/2015 |
| EP | 2474786 | | 7/2012 |
| EP | 2759669 | | 7/2014 |
| EP | 2784257 | A1 | 10/2014 |
| EP | 3045639 | | 7/2016 |
| EP | 3088648 | | 11/2016 |
| EP | 3199735 | | 8/2017 |
| EP | 3438391 | | 2/2019 |
| JP | 2003111380 | | 4/2003 |
| JP | 2014224345 | | 12/2014 |

OTHER PUBLICATIONS

European Patent Office, Notification according to Article 94 (3) EPO issued in European Patent Application No. 18 425 001.7, dated Apr. 23, 2020, 5 pp.

The State Intellectual Property Office of P. R. China, Notification of Second Office Action issued in International Application No. 201910001773.4, dated Nov. 15, 2021, 15 pp. (English translation).

* cited by examiner

HINGE FOR A HOUSEHOLD APPLIANCE

CROSS-REFERENCE TO RELATED APPLICATIONS

This application claims priority from European Patent Application No. 18 425 001.7, filed Jan. 3, 2018, which is incorporated herein by reference in its entirety.

The invention relates to a hinge for a household appliance according to the preamble of claim 1.

Such a hinge for a household appliance can for example already be taken as known from EP 2 759 669 A2. The hinge includes a hinge housing as well as a pivot arm, which is at least indirectly, in particular directly, pivotably retained at the hinge housing. Thus, the hinge arm can be pivoted around at least one pivot axis relative to the hinge housing, while the pivot arm is retained at the hinge housing. Furthermore, the hinge includes a drive device, which comprises an electric motor, by means of which the pivot arm is pivotable relative to the hinge housing.

Furthermore, DE 296 05 182 U1 discloses an electromotive furniture drive in the form of a single or double drive.

It is the object of the present invention to develop a hinge of the initially mentioned type such that the hinge can be particularly simply assembled.

This object is solved by a hinge having the features of claim 1. Advantageous configurations with convenient developments of the invention are specified in the remaining claims.

A hinge according to the invention for a household appliance includes a hinge housing and a pivot arm, which is pivotably retained at the hinge housing. Thus, the hinge arm can be pivoted, that is rotationally moved, around at least or exactly one pivot axis relative to the hinge housing, while the pivot arm is at least indirectly, in particular directly, retained at the hinge housing. Furthermore, the hinge includes a drive device, which is also referred to as actuator. The drive device includes at least or exactly one electric motor, by means of which the pivot arm is pivotable relative to the hinge housing. Hereto, the pivot arm is for example at least indirectly, in particular directly, coupleable or coupled to the electric motor.

Now, in order to be able to assemble the hinge, in particular to the household appliance, in particularly simple and thus quick and inexpensive manner, it is provided according to the invention that the drive device includes a drive housing formed separately from the hinge housing, provided in addition to the hinge housing and at least partially, in particular at least predominantly or completely, following the hinge housing in longitudinal extension direction of the hinge housing, in which the electric motor is at least partially, in particular at least predominantly or completely, received. Moreover, according to the invention, the drive device includes a threaded spindle at least partially, in particular at least predominantly or completely, received in the hinge housing, which is drivable by means of the electric motor and thereby is rotatable around a rotational axis relative to the hinge housing as well as preferably relative to the drive housing.

According to the invention, the drive device further includes at least one screw element screwed to the threaded spindle, in particular screwed onto the threaded spindle, which is for example formed as a nut. The screw element is secured against a rotation around the rotational axis relative to the hinge housing as well as preferably relative to the drive housing, such that a translational movement of the screw element relative to the hinge housing can be effected by a relative rotation occurring around the rotational axis between the threaded spindle and the screw element, whereby the pivot arm is pivotable relative to the hinge housing by means of the screw element. For example, if the threaded spindle is rotated into a first rotational direction around the rotational axis relative to the hinge housing, thus, the screw element is thereby for example translationally moved into a first direction relative to the hinge housing. Thereby, the pivot arm is for example pivoted into a first pivot direction relative to the hinge housing. For example, if the threaded spindle is rotated into a second rotational direction opposite to the first rotational direction around the rotational axis relative to the hinge housing by means of the electric motor, thus, the screw element is thereby for example translationally moved into a second direction opposite to the first direction relative to the hinge housing. Thereby, the pivot arm is for example pivoted into a second pivot direction opposite to the first pivot direction relative to the hinge housing.

For example, a household appliance is also associated with the invention, which includes an appliance housing and an appliance door pivotably retained at the appliance housing, which is for example pivotable between a closed position and at least one open position relative to the appliance housing. Therein, the household appliance further includes at least one hinge according to the invention. Therein, at least the hinge housing is for example fixed to the appliance housing and the pivot arm is for example connected to the appliance door. Thus, if the pivot arm is pivoted relative to the hinge housing, thus, pivoting of the appliance door relative to the appliance housing is thereby effected. For example by pivoting the pivot arm into the first pivot direction, the appliance door can be at least partially, in particular at least predominantly or completely, moved away from the appliance housing and thereby for example be moved from the closed position into the open position. By pivoting the pivot arm into the first pivot direction, the appliance door can for example be moved from the open position into the closed position. Thereby, particularly comfortable operation and handling of the household appliance, respectively, is representable.

Since the electric motor is at least partially received in the drive housing as well as preferably at least indirectly, in particular directly, retained at the drive housing, the electric motor and the drive housing for example constitute a first module part and the drive housing and the electric motor are constituents of a first module part, respectively. The threaded spindle and the screw element are at least indirectly retained at the hinge housing, wherein the screw element can be at least partially, in particular at least predominantly or completely, arranged in the hinge housing. Since the pivot arm is further retained at the hinge housing, the hinge housing, the threaded spindle, the screw element and the pivot arm constitute a second module part and the hinge housing, the threaded spindle, the screw element and the pivot arm are constituents of a second module part, respectively. The module parts can for example be produced and preassembled and/or handled, respectively, independently of each other.

The respective module part constitutes an assembly assembled or preassembled separately considered, which can in particular be handled independently of the respectively other assembly and in particular be assembled to the appliance housing. Thus, it is for example possible to first move and handle, respectively, the first module part independently of the second module part relative to the appliance housing and in particular to assemble it to the appliance housing, in particular while the first module part is detached from the second module part. After the first module part has been assembled to the appliance housing, the second module part can for example be moved and handled independently of the first module part and in particular in the state detached from the first module part and thus in particular be moved relative to the appliance housing as well as in particular be assembled to the appliance housing. Within the scope of the assembly of the second module part to the appliance housing, the module parts are for example composed or assembled, whereby the electric motor is for example at least indirectly, in particular directly, coupled to the threaded spindle. In the composed or assembled state of the module parts, the electric motor can drive the threaded spindle and thereby rotate it around the rotational axis relative to the hinge housing and in particular relative to the drive housing to thereby pivot the pivot arm.

Thus, the hinge according to the invention can have a modular construction, which overall allows particularly simple assembly of the hinge. Since the module parts can be handled independently of each other, and since the respective module part overall has lower outer dimensions than the hinge considered separately in a state, in which the module parts are composed or assembled, the respective module part can be particularly simply handled in the state separated from the respectively other module part and be simply and thus quickly and inexpensively assembled even with narrow space conditions.

A particularly simple assembly of the hinge is in particular realizable in that the drive housing adjoins to the hinge housing in longitudinal extension direction of it in the completely produced state of the hinge, that is if the module parts are composed or assembled. Thereby, the installation space requirement of the hinge can be kept particularly low in a direction extending obliquely or perpendicularly to the longitudinal extension direction of the hinge housing. In other words, an installation height of the hinge can be kept particularly low such that the hinge can be particularly well accommodated and assembled, respectively, even with narrow space conditions. The longitudinal extension direction of the hinge housing in particular coincides with a movement direction coinciding with the first and with the second direction, along which the screw element can be moved relative to the hinge housing by rotating the threaded spindle.

The invention is based on the realization that the hinge can optionally not be assembled in a state, in which the module parts are composed, for space reasons. A further problem is in that a usual assembly sequence provides to assemble the hinge to the appliance door always only at the end. Thus, very narrow space conditions already exist in the assembly of the hinge such that the hinge also referred to as actuator cannot be assembled anymore or only in very inconvenient manner. However, these problems and disadvantages can now be avoided by the modular construction of the hinge according to the invention. The second module part preferably includes force-transmitting components like the threaded spindle, the screw element as well as for example at least one or more thrust bearings and/or at least one or more radial bearings and/or at least one tappet. The threaded spindle is for example supported on the hinge housing in axial direction of the threaded spindle via the at least one thrust bearing. Alternatively or additionally, the threaded spindle is for example supported on the hinge housing in radial direction of the threaded spindle via the at least one radial bearing. For example, transmission of forces from the screw element to the pivot arm is effected via the mentioned tappet such that the pivot arm is for example thereby pivotable relative to the hinge housing via the tappet by means of the screw element, such that the screw element and with it for example the tappet are translationally moved into the respective direction relative to the hinge housing.

The electric motor can for example be fixed or assembled to the appliance housing via the drive housing. In particular, the electric motor can for example be assembled onto or to a floor tray of the appliance housing via the drive housing. Thus, the drive housing functions as a motor retainer, which is also simply referred to as retainer.

In particular, it is conceivable to first assemble the first module part and thus the electric motor and the drive housing to the appliance housing, in particular to the floor tray, in independent manner and in the state detached from the second module part. Hereto, the first module part is for example first handled independently of the second module part and in particular in the state detached from the second module part and in particular moved relative to the second module part and relative to the appliance housing and assembled to the appliance housing. Subsequent thereto, the second module part is for example handled independently of the first module part and in the state detached from the first module part and therein moved relative to the first module part and relative to the appliance housing, in particular while the first module part is already assembled to the appliance housing. Then, the second module part is for example at least indirectly, in particular directly, assembled to the appliance housing and therein composed or assembled to the first module part already assembled to the appliance housing, whereby the threaded spindle is for example coupled to the electric motor. Thus, the module parts can be handled and assembled to the appliance housing independently of each other. In particular, the module parts can be handled in the state detached or separated from each other and be assembled to the appliance housing such that the hinge can overall be simply and quickly and inexpensively assembled.

For example, after the first module part has been assembled to the appliance housing, the second module part and thus the hinge housing, the threaded spindle, the screw element and the hinge arm can be at least partially inserted into the appliance housing from a front side of the appliance housing through a front panel, and therein the threaded spindle can be at least indirectly connected or coupled to the electric motor. Therein, an at least indirect rotationally fixed coupling or connection of the threaded spindle to the electric motor, in particular to a rotor of the electric motor, is in particular effected. For example, the electric motor is formed as a rotating motor and includes a stator and a rotor, which is drivable by the stator and thereby rotatable around a rotational axis relative to the stator. For example, the electric motor can provide torques via the rotor, by means of which the threaded spindle can be rotated.

In the assembled or composed state of the module parts, the threaded spindle is for example positively coupled to the rotor. In the hinge, the threaded spindle is for example in particular connected, in particular rotationally fixedly connected, to the electric motor, in particular to the rotor, via a tooth connection, in particular via a multi-tooth connection. The drive housing and thus the electric motor are for example fixed or fixable to the appliance housing via the retainer. In other words, the first module part for example includes the retainer, via which the electric motor is fixable to the appliance housing. Therein, the retainer is preferably formed funnel-shaped at least in a partial area such that it guides and centers for example the hinge housing when the hinge housing is at least partially shifted or inserted into the drive housing. By this centering, respective toothings of the rotor and the threaded spindle in particular formed as serrations can be centered or aligned relative to each other. The toothings are for example splines, which can be inserted into each other in particular along the direction of movement to thereby positively connect the threaded spindle to the rotor. This connection is assisted by the funnel-shaped retainer.

Preferably, the hinge housing is directly or immediately supported on the drive housing such that the hinge housing for example directly or immediately contacts the drive housing. Hereby, a supporting moment of the electric motor can for example be transmitted from the electric motor to the drive housing and from the drive housing directly into the hinge housing such that the electric motor can be particularly advantageously supported against an undesired rotation relative to the drive housing, in particular if the threaded spindle is driven by means of the electric motor.

By the modular construction of the hinge according to the invention, the usual assembly sequence can be maintained. Further, protruding components of the hinge can be avoided. A further advantage is in that the electric motor representing a potential noise source can be arranged in the appliance housing particularly far behind in longitudinal extension direction of the hinge housing such that an excessive noise development can be avoided. Thereby, the electric motor can further be arranged at such a location, at which the electric motor can be particularly advantageously isolated with respect to structure-borne noise. Compared to conventional hinges, the drive device is located further down, whereby a temperature load acting on the drive device can then in particular be kept particularly low if the household appliance is formed as a baking oven or other cooking appliance. In addition, a particularly advantageous accessibility to the hinge can be ensured in particular in case of maintenance and repair, respectively.

The above mentioned household appliance is for example a cooking appliance such as in particular a stove, in particular an electric stove or a gas stove. In particular, the household appliance can be a baking oven. However, the hinge can also be readily used for other household appliances.

By the feature that the drive housing is formed separately from the hinge housing and provided in addition thereto, it can in particular be understood that the hinge housing and the drive housing are two components formed separately from each other and connected or connectable to each other. Further, by the feature that the drive housing at least partially follows the hinge housing in longitudinal extension direction of the hinge housing, it is to be understood that the drive housing at least partially adjoins to the hinge housing in longitudinal extension direction of the hinge housing such that the drive housing is at least partially, in particular at least predominantly or completely, arranged outside of the hinge housing, in particular related to the longitudinal extension direction of the hinge housing.

In advantageous configuration of the invention, the threaded spindle is at least predominantly, in particular completely, received in the hinge housing along the rotational axis. Thereby, the second module part can be particularly simply handled and thus be quickly and inexpensively assembled.

In order to realize a particularly simple capability of assembly, the electric motor and the drive housing adjoin to the hinge housing at an end of it opposing the pivot arm.

In a particularly advantageous embodiment of the invention, the drive housing and/or the electric motor are at least partially, in particular at least predominantly or completely, covered by the hinge housing along the rotational axis towards the pivot arm. This means that the drive housing and the electric motor are not just arranged completely offset to the hinge housing in a direction extending perpendicularly to the rotational axis but the drive housing and the electric motor quasi adjoin to the hinge housing in extension of it, in particular on a side of the hinge housing opposing the pivot arm. Hereby, the hinge can be particularly simply assembled.

In order to be able to handle and compose the module parts independently of each other in particularly simple manner, it is provided in further configuration of the invention that a length area of the threaded spindle protrudes from the hinge housing and is received in the drive housing. In particular, the threaded spindle is coupled, in particular rotationally fixedly connected, to the electric motor, in particular to the rotor, via the length area.

A further embodiment is characterized in that the threaded spindle is rotationally fixedly connected to the electric motor, in particular to the rotor, in particular in reversibly detachable manner, via a plug connection. In this manner, the module parts can for example be assembled or composed in particularly simple manner in that the module parts, in particular the threaded spindle and the rotor, are plugged together or plugged into each other, in particular by moving the threaded spindle along the rotational axis relative to the rotor and for example plugging it into the drive housing.

In further configuration of the invention, the drive housing is in particular reversibly detachably connected to the hinge housing. Thereby, the module parts can be particularly simply assembled or composed and again be detached from each other such that the hinge overall can be assembled to the appliance housing and disassembled from the appliance housing in simple manner.

The hinge housing is also referred to as first housing and is a first housing of the hinge, respectively. The drive housing is for example a second housing of the hinge and is also referred to as second housing, respectively. Therein, it is preferably provided that a length area of one of the housings is received in the respectively other housing. Hereby, the module parts can for example be composed in particularly simple manner in that the length area of the one housing is plugged into the respectively other housing, in particular along the rotational axis. Herein, the funnel-shaped retainer for example functions as a guide to guide the one housing when the length area thereof is plugged into the respectively other housing.

In further configuration of the invention, the drive device includes a transmission, which has a transmission ratio different from 1 and is at least partially, in particular at least predominantly or completely, received in the drive housing. Therein, the transmission is preferably at least indirectly, in particular directly, retained at the drive housing. Therein, the transmission is preferably also a constituent of the previously mentioned first module part such that the transmission can be assembled in simple manner. Therein, the threaded spindle is drivable by the electric motor via the transmission. By the use of the transmission, the electric motor can be configured particularly favorable in weight and installation space such that the weight and the installation space requirement of the hinge can overall be kept particularly low. Thereby, the hinge can be particularly simply and thus quickly and inexpensively assembled.

Finally, it has proven particularly advantageous if the transmission is at least predominantly, in particular completely, received in the drive housing along the rotational axis. Thereby, a particularly compact construction can be realized such that the hinge can be particularly simply assembled.

Further advantages, features and details of the invention are apparent from the following description of a preferred embodiment as well as based on the drawing. The features and feature combinations mentioned above in the description as well as the features and feature combinations mentioned below in the description of figures and/or shown in the figures alone are usable not only in the respectively specified combination, but also in other combinations or alone without departing from the scope of the invention.

Figure 2:
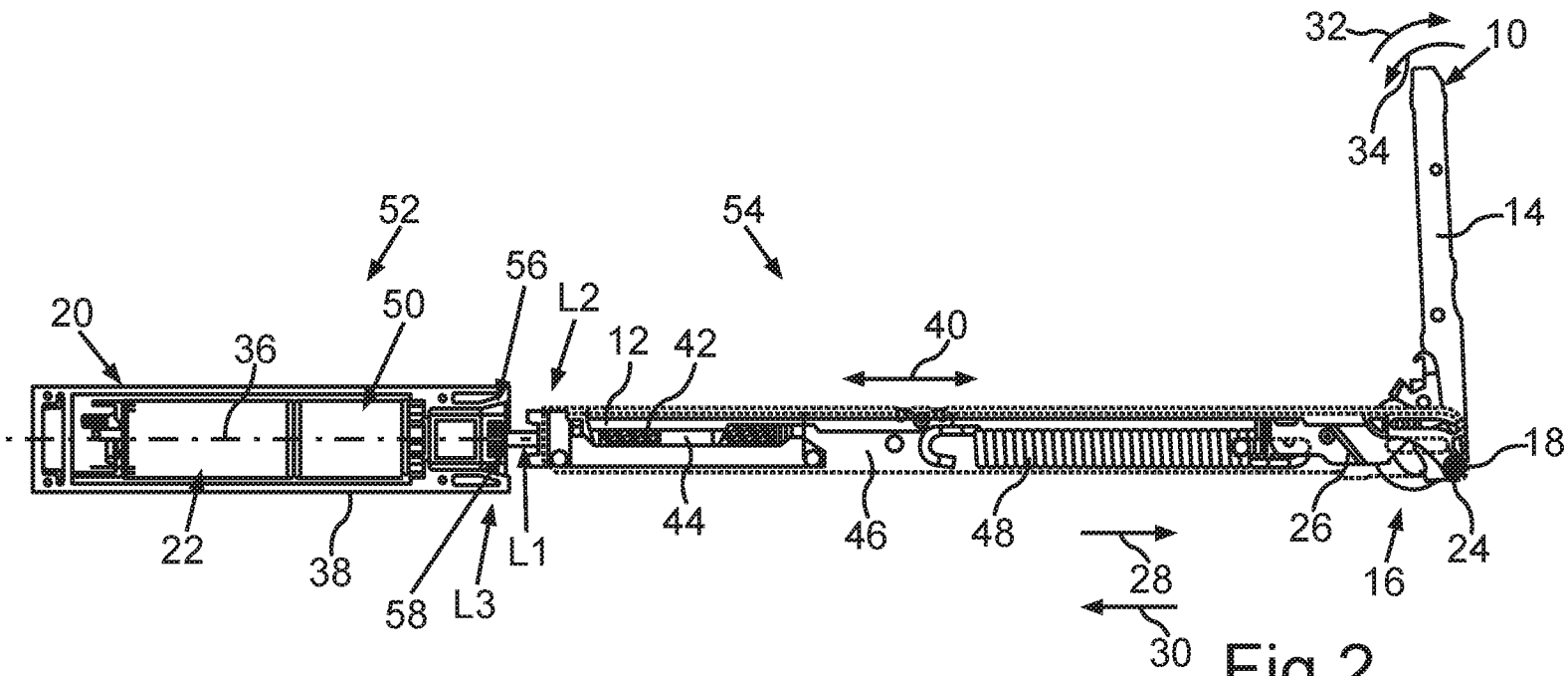

The drawing shows in:

FIG. 1 a schematic and perspective as well as partially sectioned exploded view of a hinge according to the invention; and FIG. 2 a schematic and partially sectioned exploded side view of the hinge.

In the FIGS., identical or functionally identical elements are provided with identical reference characters.

FIGS. 1 and 2 each show a hinge 10 for a household appliance in a schematic exploded view. The hinge 10 includes a hinge housing 12, which is transparently illustrated in FIG. 2. In addition, the hinge 10 includes a pivot arm 14, which is for example arranged at a first end 16 of the hinge housing 12 and therein is retained at the hinge housing at the end 16 of the hinge arm. This means that the pivot arm 14 can be pivoted, that is rotationally moved, around a pivot axis defined by a bolt 18 relative to the hinge housing 12, while the pivot arm 14, which is also referred to as hinge arm, is retained at the hinge housing 12. Therein, the pivot arm 14 is pivotably retained at the hinge housing 12 at least via the bolt 18. Further, the hinge 10 includes a drive device 20 also referred to as actuator, which comprises an electric motor 22 for example formed as a rotating motor. By means of the electric motor 22, the pivot arm 14 can be pivoted around the pivot axis relative to the hinge housing 12.

For example, the pivot arm 14 is pivotable between at least one first position and at least one second position relative to the hinge housing 12. The pivot axis defined by the bolt 18 is denoted by 24 in FIG. 2. Further, the hinge 10 includes a carriage 26 particularly well apparent from FIG. 2. The carriage 26 is supported on the hinge housing 12 translationally movably relative to the hinge housing 12 and therein in particular at least partially, in particular at least predominantly or completely, arranged and received in the hinge housing 12, respectively. In other words, the carriage 26 is longitudinally displaceably supported on the hinge housing 12. In FIG. 2, an arrow 28 illustrates a first direction, into which the carriage 26 is translationally movable relative to the hinge housing 12. Further, an arrow 30 illustrates a second direction opposite to the first direction, into which the carriage 26 is translationally movable relative to the hinge housing 12.

Further, a first pivot direction is illustrated by an arrow 32, into which the pivot arm 14 is pivotable around the pivot axis 24 relative to the hinge housing 12. Furthermore, an arrow 34 illustrates a second pivot direction opposite to the first pivot direction in FIG. 2, into which the pivot arm 14 can be pivoted around the pivot axis 24 relative to the pivot housing 12. The carriage 26 is at least indirectly, in particular directly, coupled to the pivot arm 14 such that the pivot arm 14 is pivoted into the first pivot direction if the carriage 26 is moved into the first direction. If the carriage 26 is moved into the second direction, thus, the pivot arm 14 is thereby pivoted into the second pivot direction. The electric motor 22 includes a stator not apparent in more detail in the FIGS. and a rotor, which is drivable by the stator and thereby rotatable around a rotational axis 36 relative to the stator and in particular relative to the hinge housing 12. Therein, the rotor can be rotated around the rotational axis 36 into a first rotational direction and into a second rotational direction opposite to the first rotational direction.

The mentioned household appliance includes an appliance housing and an appliance door, which is simply referred to as door. Therein, the door is at least indirectly, in particular directly, pivotably retained at the appliance housing and can thus be pivoted between a closed position and at least one open position relative to the appliance housing. Therein, the hinge housing 12 is for example at least indirectly, in particular directly, retained at or fixed to the appliance housing, while the pivot arm 14 is for example at least indirectly, in particular directly, connected to the appliance door. Thus, if the pivot arm 14 is for example moved into the first pivot direction, thus, the appliance door can thereby be moved from the closed position into the open position. For example, if the pivot arm 14 is pivoted into the second pivot direction, thus, the door is thereby for example moved from the open position into the closed position. The movement of the door from the closed position into the open position is also referred to as opening the door, wherein the movement of the door from the open position into the closed position is also referred to as closing the door.

Now, in order to be able to particularly simply and thus quickly and inexpensively assemble the hinge 10, in particular to the appliance housing, the drive device 20 includes a drive housing 38 formed separately from the hinge housing 12 and provided additionally to the hinge housing 12, which for example functions as a retainer. The retainer is also referred to as motor retainer. As is particularly well apparent from FIGS. 1 and 2, the drive housing 38 at least partially, in particular at least predominantly or completely, follows the hinge housing 12 in longitudinal extension direction of the hinge housing 12, wherein the electric motor 22 is at least partially, in particular at least predominantly or completely, arranged and received in the drive housing 38, respectively. In FIGS. 1 and 2, the longitudinal extension direction of the hinge housing 12 is illustrated by a double arrow 40, wherein the longitudinal extension direction of the hinge housing 12 for example coincides with the rotational axis 36 or extends along the rotational axis 36. Moreover, the drive device 20 includes a threaded spindle 42 at least partially, in particular at least predominantly, received in the hinge housing 12, which is drivable by means of the electric motor 22, in particular by means of the rotor, and thereby is rotatable around a spindle rotational axis relative to the hinge housing 12. In the embodiment illustrated in the FIGS., the spindle rotational axis coincides with the rotational axis 36 such that the threaded spindle 42 is rotatable around the rotational axis 36 relative to the hinge housing 12. Thus, the threaded spindle 42 is arranged coaxially with the electric motor 22, in particular with the rotor thereof. Thus, the threaded spindle 42 can be driven by the stator via the rotor. Thus, the rotor and via it the threaded spindle 42 can be rotated around the rotational axis 36 into a first rotational direction and into a second rotational direction opposite to the first rotational direction relative to the hinge housing 12 and in particular relative to the drive housing 38.

Moreover, the drive device 20 includes a screw element in the form of a spindle nut 44 at least partially, in particular at least predominantly or completely, received in the hinge housing 12 and screwed to the threaded spindle 42, which is secured against rotation around the rotational axis 36 relative to the hinge housing 12 and in particular relative to the drive housing 38. Thus, a translational movement of the spindle nut 44 relative to the hinge housing 12 can be effected by a relative rotation occurring around the rotational axis 36 between the threaded spindle 42 and the spindle nut 44, whereby the pivot arm 14 is pivotable relative to the hinge housing 12 by means of the spindle nut 44.

The spindle nut 44 for example comprises a first thread in the form of an external thread. The spindle nut 44 for example comprises a second thread in the form of an internal thread corresponding to the external thread. Therein, the spindle nut 44 is screwed to the threaded spindle 42 via the threads and in particular screwed onto the threaded spindle 42. For example, if the threaded spindle 42 is rotated into the first rotational direction around the rotational axis 36 relative to the hinge housing 12, thus, the spindle nut 44 is thereby translationally moved into the first direction illustrated by the arrow 28 relative to the hinge housing 12. For example, if the threaded spindle 42 is for example rotated into the second rotational direction, thus, the spindle nut 44 is thereby for example translationally moved into the second direction illustrated by the arrow 30 relative to the hinge housing 12.

For example, the spindle nut 44 is at least indirectly, in particular directly, connected to the carriage 26. Thus, if the spindle nut 44 is moved into the first direction, thus, the carriage 26 is thereby moved into the first direction. Accordingly, if the spindle nut 44 is moved into the second direction, thus, the carriage 26 is thereby for example moved into the second direction. In particular, the spindle nut 44 is for example coupled or connected to the carriage 26 via a coupling element 46, wherein the coupling element is for example formed as a sheet, in particular as an actuating sheet, and is translationally movable relative to the hinge housing 12 and relative to the drive housing 38 along a movement direction coinciding with the first direction and with the second direction like the spindle nut 44 and the carriage 26.

Moreover, the hinge 10 for example includes a spring 48, which is at least indirectly, in particular directly, coupled or connected to the carriage 26 on the one hand and at least indirectly, in particular directly, coupled or connected to the hinge housing 12 on the other hand. For example, the first position of the pivot arm 14 is shown in FIGS. 1 and 2. If the pivot arm 14 is pivoted into the first pivot direction, whereby the pivot arm 14 is for example moved from the first position into the second position, thus, the spring 48 is thereby tensioned. By pivoting the pivot arm 14 into the first pivot direction, the door is for example opened. By tensioning the spring 48, it provides a spring force, which acts on the pivot arm 14 via the carriage 26 and via it on the door. For example, a first torque results from this spring force, which acts around the pivot axis 24 into the second pivot direction. The first torque is also referred to as closing moment since it is used for closing the door and since the door is movable into the closed position by means of the closing moment, respectively. Related to the image plane in FIG. 2, the closing moment acts counterclockwise.

At least in the open position, the weight force of the door causes a second torque, which acts around the pivot axis 24 into the first pivot direction opposite to the second pivot direction and is also referred to as opening moment since the door is movable into the open position by means of the opening moment. The opening moment is opposite to the closing moment.

When the door is moved from the open position towards the closed position such that the pivot arm 14 is moved from the second position towards the first position, thus, the closing moment becomes greater than the opening moment from a first intermediate position different from the closed position and the open position and associated with a pivot area, in which the pivot arm 14 and the door are pivotable, such that the door is completely moved, in particular pulled, into the closed position from the first intermediate position by means of the closing moment and by means of the spring force, respectively. When the door is moved from the closed position towards the open position such that the pivot arm 14 is moved from the first position towards the second position, thus, the opening moment becomes greater than the closing moment from a second intermediate position different from the closed position and from the open position and the first position and the second position, respectively, and associated with the pivot area such that the door is completely moved into the open position from the second intermediate position by means of the opening moment and by means of the weight force and thus caused by gravity, respectively. For example, the intermediate positions differ from each other.

Further, the drive device includes a transmission 50, which has a transmission ratio different from 1 and is at least partially, in particular at least predominantly or completely, received in the drive housing 38. Therein, the threaded spindle 42 is drivable by the electric motor 22, in particular by the rotor, via the transmission 50. The electric motor 22 and the transmission 50 are each at least indirectly, in particular directly, retained at the drive housing. Further, the threaded spindle 42, the spindle nut 44, the carriage 26, the pivot arm 14, the spring 48 and the coupling element 46 are each at least indirectly retained at the hinge housing 12. Thus, the drive housing 38, the electric motor 22 and the transmission 50 for example constitute a first module part 52. The hinge housing 12, the pivot arm 14, the carriage 26, the threaded spindle 42, the spindle nut 44, the coupling element 46 and the spring 48 for example constitute a second module part 54, wherein the module parts 52 and 54 are respective assemblies contiguous or assembled separately viewed. The respective module part 52 and 54, respectively, can be handled and moved independently of the respectively other module part 54 and 52, respectively, such that the respective module part 52 and 54, respectively, can be moved relative to the respectively other module part 54 and 52, respectively. In particular, the module parts 52 and 54 can be moved relatively to each other and independently of each other in the state detached from each other, that is in a state, in which the module parts 52 and 54 are separated from each other or detached from each other, that is not composed or assembled.

In this manner, it is for example possible to first move the module part 52 in the state detached from the module part 54 relative to the module part 54 and relative to the appliance housing and thus independently of the module part 54 and to assemble it to the appliance housing, in particular while the module part 54 is separated or detached from the module part 52. Therein, the drive housing 38 functions as a retainer, in particular as a motor retainer, since the electric motor 22 and the transmission 50 are fixable or fixed to the appliance housing via the drive housing 38.

After the module part 52 has been fixed to the appliance housing via the drive housing 38, the module part 54 can be moved in the state detached or separated from the module part 52 relative to the appliance housing and relative to the module part 52 already fixed to the appliance housing and in particular be fixed to the appliance housing, while the module part 52 is already fixed to the appliance housing. Within the scope of fixing the module part 54 to the appliance housing, the module parts 52 and 54 are connected to each other, that is composed or assembled. Herein, the threaded spindle 42 is for example, in particular positively, connected, in particular rotationally fixedly connected to the transmission 50 and thus to the electric motor 22, such that the threaded spindle 42 can then be driven by the electric motor 22 via the transmission 50 and thus can be rotated around the rotational axis 36 relative to the hinge housing 12.

From FIGS. 1 and 2, it is particularly well apparent that the threaded spindle 42 is at least predominantly received in the hinge housing 12 along the rotational axis 36. Further, the module part 52 adjoins to the hinge housing 12 in longitudinal extension direction of it such that the drive housing 38 and/or the electric motor 22 as well as optionally the transmission 50 are at least partially covered by the hinge housing 12 along the rotational axis 36 and thus in longitudinal extension direction of the hinge housing 12 towards the pivot arm 14. Therein, the electric motor 22 and the transmission 50 are at least predominantly, in particular completely, received in the drive housing 38 along the rotational axis 36.

Moreover, a length area L1 of the threaded spindle 42 protrudes from the hinge housing 12 in longitudinal extension direction of the hinge housing 12 and along the rotational axis 36, respectively, and is received in the drive housing 38. The threaded spindle 42 is, in particular positively, connected to the transmission 50 and thus to the electric motor 36, in particular to the rotor, via the length area L1. Hereto, the threaded spindle 42 for example comprises a first toothing at least in the length area L1, which is for example formed as a spline. The transmission 50 and the electric motor 22, in particular the rotor, respectively, for example comprise a second toothing corresponding to the first toothing, which is for example also formed as a spline. Therein, the threaded spindle 42 can be rotationally fixedly connected to the electric motor 22, in particular to the rotor, such that the toothings are inserted into each other along the rotational axis. Hereby, the threaded spindle 42 is reversibly detachably connected to the electric motor 22 such that the module parts 52 and 54 can be adequately connected to each other and detached from each other in simple manner.

In addition, it is preferably provided that the drive housing 38 is at least indirectly, in particular directly, reversibly detachably connected to the hinge housing 12. Hereby, the torques can for example be particularly advantageously transmitted from the electric motor 22 to the drive housing 38 and directly introduced from it into the hinge housing 12.

Furthermore, the hinge housing 12 has a length area L2, which is received in the drive housing 38. It is particularly well apparent from FIG. 2 that the module parts 52 and 54 are connected to each other, that is composed or assembled, such that the length area L2 of the hinge housing 12 is inserted into the drive housing 38 along the rotational axis 36 to thereby insert the splines into each other. Therein, the drive housing 38 is funnel-shaped formed at least in a length area L3, in which the length area L2 is received and through which the length area L2 is inserted, such that wall areas 56 of the drive housing 38 taper or converge to each other towards the electric motor 22 along the rotational axis 36. Therein, the wall areas 56 bound an insertion opening 58, via which the length area L2 is inserted or insertable into the drive housing 38. Therein, the wall areas 56 function as an introduction funnel or introduction aid, by means of which the hinge housing 12 is aligned or centered relative to the drive housing 38 if it is inserted into the drive housing 38 via the insertion opening 58. Hereby, the toothings particularly simply get together and can be inserted into each other along the rotational axis 36. Hereby, the module parts 52 and 54 can be particularly simply and thus quickly and inexpensively connected to each other.

Therein, the transmission 50 has a transmission ratio different from 1 such that the weight and the installation space requirement of the electric motor 22 and thus of the drive device 20 can overall be kept particularly low. Therein, the transmission 50 is also at least predominantly, in particular completely, received in the drive housing 38 along the rotational axis 36.

In particular, the coupling element 46 is for example coupled to the spindle nut 44 on the one hand and to the carriage 26 on the other hand such that the coupling element 46 is translationally movable into at least one neutral position relative to the hinge housing 12 via the spindle nut 44 and the threaded spindle 42 by means of the electric motor 22, in which the pivot arm 14 and via it the carriage 26 are movable relative to the hinge housing 12 and relative to the drive device 20 independently of the drive device 20. In other words, if the coupling element 46 is in the neutral position, thus, the pivot arm 14 can be pivoted relative to the hinge housing 12 and thereby the carriage 26 can be translationally moved relative to the hinge housing 12 via the pivot arm 14, while movements of the drive device 20 are omitted, that is while rotations of the threaded spindle 42 and the rotor around the rotational axis 36 are omitted and while translational movements of the spindle nut 44 and the coupling element 46 relative to the hinge housing 12 along the movement direction are omitted. This means that the drive device 20, in particular the coupling element 46, is not moved via the carriage 26 and the pivot arm 14 if the coupling element 46 is in the neutral position and therein the carriage 26 and the pivot arm 14 are moved relative to the hinge housing 12. This further means that the drive device 20 does not influence movements of the carriage 26 and the pivot arm 14 if the coupling element 46 is in the neutral position. In this manner, the appliance door—while the coupling element 46 is in the neutral position—can for example be manually opened and/or closed by a person, in particular upon power failure, without the drive device 20 being opposed to closing and opening the appliance door, respectively. Thereby, particularly comfortable operation can be realized.

The invention claimed is:

1. A hinge for a household appliance, the hinge comprising:

an enclosed hinge housing;

a pivot arm pivotably retained at a first longitudinal end of the hinge housing;

a drive housing arranged separately and removably attached to a second longitudinal end of the hinge housing, the drive housing receiving a drive device;

a threaded spindle at least partially received in the hinge housing, which is drivable by means of the drive device and thereby is rotatable relative to the hinge housing around a rotational axis;

the drive device comprising an electric motor by means of which the pivot arm is pivotable relative to the hinge housing, the drive device also comprising a transmission via which the threaded spindle is driven by the electric motor; and at least one screw element screwed to the threaded spindle, the screw element secured against rotation around a rotational axis relative to the hinge housing, such that a translational movement of the screw element relative to the hinge housing is effected by relative rotation occurring around the rotational axis between the threaded spindle and the screw element, whereby the pivot arm pivots about an axis perpendicular to the rotational axis relative to the hinge housing and drive housing by means of the screw element.

2. The hinge according to claim 1, wherein the threaded spindle is at least predominantly received in the hinge housing along the rotational axis.

3. The hinge according to claim 1, wherein the drive housing and/or the electric motor are at least partially covered by the hinge housing along the rotational axis towards the pivot arm.

4. The hinge according to claim 1, wherein the electric motor is at least predominantly received in the drive housing along the rotational axis.

5. The hinge according to claim 1, wherein a length area of the threaded spindle protrudes from the hinge housing and is received in the drive housing.

6. The hinge according to claim 1, wherein the threaded spindle is rotationally fixedly connected to the electric motor via a plug connection.

7. The hinge according to claim 1, wherein the hinge housing is a first housing and the drive housing is a second housing of the hinge, wherein a length area (L2) of one of the housings is received in the other housing.

8. The hinge according to claim 1, wherein the transmission has a transmission ratio different from 1.

9. The hinge according to claim 8, wherein the transmission is at least predominantly received in the drive housing along the rotational axis.

10. A hinge for a household appliance having a modular construction, the hinge comprising:

a first module part comprising a drive housing receiving a motor and a transmission;

a second module part comprising a hinge housing, the hinge housing receiving a threaded spindle and at least one screw element coupled to the threaded spindle, the threaded spindle rotatable around a rotational axis relative to the hinge housing, the screw element translatable relative to the hinge housing but secured against rotation around a rotational axis relative to the hinge housing such that rotation of the threaded spindle causes translation of the screw element;

the hinge housing and the drive housing adjoining in a reversibly detachable manner in a longitudinal extension direction along the rotational axis; and a pivot arm pivotably retained at a first end of the hinge housing and coupled to the screw element;

wherein the threaded spindle is detachably coupled to the motor when the hinge housing is adjoined to the drive housing such that the motor is capable of rotating the threaded spindle around the rotational axis relative to the screw element, thus causing translation of the screw element, whereby the pivot arm is pivotable about an axis perpendicular to the rotational axis relative to the hinge housing by means of the screw element.

11. The hinge of claim 10, wherein the drive housing comprises a funnel-shaped area with converging walls converging toward the motor, the funnel-shaped area configured to receive a portion of the hinge housing and align the hinge housing relative to the drive housing.

12. The hinge of claim 10, wherein the threaded spindle is coaxial with a rotor of the motor.

13. The hinge of claim 10, further comprising a carriage supported on the hinge housing and translationally movably relative to the hinge housing, the carriage coupled to the pivot arm at a first end and coupled to the spindle nut at a second end.

14. The hinge of claim 13, further comprising a spring coupled to the carriage and to the hinge housing.

15. The hinge of claim 13, further comprising a coupling element coupled to the spindle nut and the carriage such that the coupling element is translationally movable into a neutral position to disconnect the motor and hinge arm so that the motor does not influence movement of the hinge arm when the coupling element is in the neutral position.

* * * * *